US006860619B2

(12) United States Patent
Swanson

(10) Patent No.: US 6,860,619 B2
(45) Date of Patent: Mar. 1, 2005

(54) TREE TORCHIERE WITH FULLY FLEXIBLE ARMS

(75) Inventor: Dennis K. Swanson, Woodland Hills, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 0 days.

(21) Appl. No.: 10/460,025

(22) Filed: Jun. 11, 2003

(65) Prior Publication Data

US 2004/0252505 A1 Dec. 16, 2004

(51) Int. Cl.[7] ..... F21S 1/12

(52) U.S. Cl. ..... 362/250; 362/410; 362/431; 362/419; 362/287

(58) Field of Search ..... 362/410, 414, 362/419, 198, 287, 250, 249, 431, 252

(56) References Cited

U.S. PATENT DOCUMENTS

| | | | | | |
|---|---|---|---|---|---|
| 1,369,644 | A | * | 2/1921 | Forster | 362/198 |
| 5,632,553 | A | * | 5/1997 | Huang | 362/410 |
| 6,264,350 | B1 | * | 7/2001 | Swanson | 362/414 |
| 6,502,957 | B1 | * | 1/2003 | Klaitman | 362/250 |
| D481,154 | S | * | 10/2003 | Swanson | D26/102 |

* cited by examiner

*Primary Examiner*—Thomas M. Sember
(74) *Attorney, Agent, or Firm*—Fulbright & Jaworski L.L.P.

(57) ABSTRACT

A tree torchiere lamp having a general area lighting means connected to one end of a stem which, in turn, is supported upon a base. At least two task lights are rigidly connected to the stem at points longitudinally spaced apart along the stem by a fully flexible arm allowing the task light to be positioned in a multitude of positions surrounding the stem.

1 Claim, 4 Drawing Sheets

TREE TORCHIERE WITH FULLY FLEXIBLE ARMS

BACKGROUND OF THE INVENTION

1. Field of the Invention

The present invention relates generally to electric lighting apparatus and, more particularly, to tree torchieres, which include the combination of general area lighting and task lighting on the same structure. More specifically, the present invention relates to such a structure in which the task lights are attached to a stem by means of fully flexible arms.

2. Prior Art

Electric lighting apparatus in the form of floor lamps, table lamps and tree torchieres are well known. Typical floor lamps and table lamps function as apparatus for providing general area lighting or specific or task lighting. The tree torchiere provides the combination of both general area lighting and task lighting in the same structure. The task lighting focuses the light through the utilization of reflectors or the like for use for specific purposes such as reading or to highlight a given or area to accent an item such as a sculpture, painting or the like.

These prior art structures function well for the specific purposes intended. However, the adjustability of the task lights is limited in that such task lights are attached in an adjustable fashion very closely to the stem upon which the general area lighting means is affixed. There is thus a need in the art for a tree torchiere lamp having task lights which are readily adjustable to a large variety of positions and which may be used for various purposes, not hitherto possible.

SUMMARY OF THE INVENTION

A tree torchiere lamp including an elongated stem supported by a base and carrying a general area lighting means at its opposite ends. A plurality of task lights connected to the elongated stem utilizing a flexible arm to permit the task light to be placed in any position desired on a surface surrounding the stem and defined by all possible positions of the distal end of the arm.

DETAILED DESCRIPTION

A tree torchiere lamp constructed in accordance with the principles of the present invention provides a flexibility in illumination from a single lamp not heretofore known or recognized. The torchiere lamp of the present invention provides the usual general area lighting means in the form of an upwardly-directed, bowl-shaped member as is well known in the art. In addition, there are provided at least two task lights each of which is affixed to the stern of the tree torchiere by means of a fully flexible arm. As a result, the task lights may be disposed in positions not heretofore possible such that increased general area lighting may be accomplished, for example, by concentrating the light from a task light so that it bounces off an adjacent wall, thus providing increased general area illumination to supplement that from the upwardly-directed bowl. At the same time, the other task light which is also connected by way of a fully flexible arm, may be utilized in the typical task light situation such as, for example, to provide light for reading or to highlight a particular item such as a painting, sculpture or the like. If desired, the other task light may also be manipulated in such a manner that it can provide lighting such as backlighting for an adjacent plant, sculpture or the like. As can be seen, the two task lights connected to the stem by a fully flexible arm provide a great deal of flexibility in the manner in which the light emanating from the task lights may be utilized.

Figure 1:
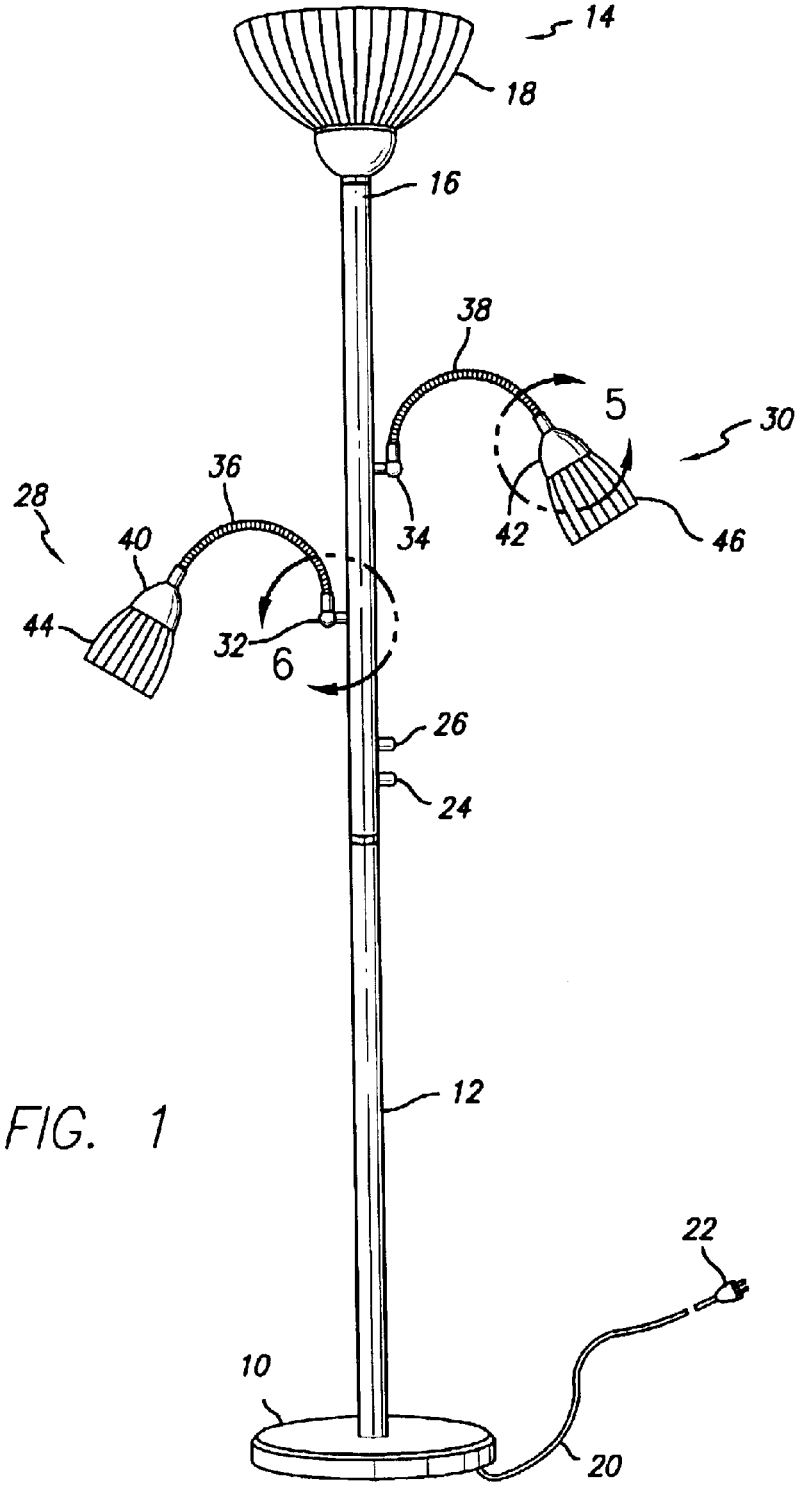
FIG. 1 is a plan view of a lamp constructed in accordance with the principles of the present invention.

A torchiere lamp constructed in accordance with the principles of the present invention is illustrated in FIG. 1 to which reference is hereby made. As is therein shown, there is provided a base 10 having a stem 12 disposed and connected to the base 10 substantially at the center thereof and rising centrally therefrom. A general area lighting means 14 is connected at the opposite end 16 of the stem and includes an upwardly-directed bowl or reflector member 18. Disposed within the bowl 18 is an electric light (not shown) which may be incandescent, fluorescent or a halogen light as may be desired depending upon the particular application. Extending from the base 10 is an electrical cord 20 having a plug 22 for connection to a wall outlet as is well known in the art. A pair of switches 24 and 26 are positioned along the stem 12 for the purpose of applying electrical power to task lights 28 and 30 as well as the general area lighting means 14.

The task lights 28 and 30 are non-removably affixed to the stem 12 by means of members 32 and 34, respectively, which are nonremovably attached to the stem 12 and which carry a fully flexible arm 36 and 38, respectively. Each of the arms 36 and 38 include first and second ends with the first end being affixed to the members 32 and 34 while the second end thereof is affixed to the task lights 28 and 30. A fitting 40 and 42 is affixed to the second or distal end of the flexible arms 36 and 38, respectively, and receives an electrical socket which, in turn, receives a light bulb. An appropriate shade or reflector 44 and 46 is affixed to the fitting 40 and 42, respectively, and directs or focuses the light as may be desired for a particular application.

Figure 2:
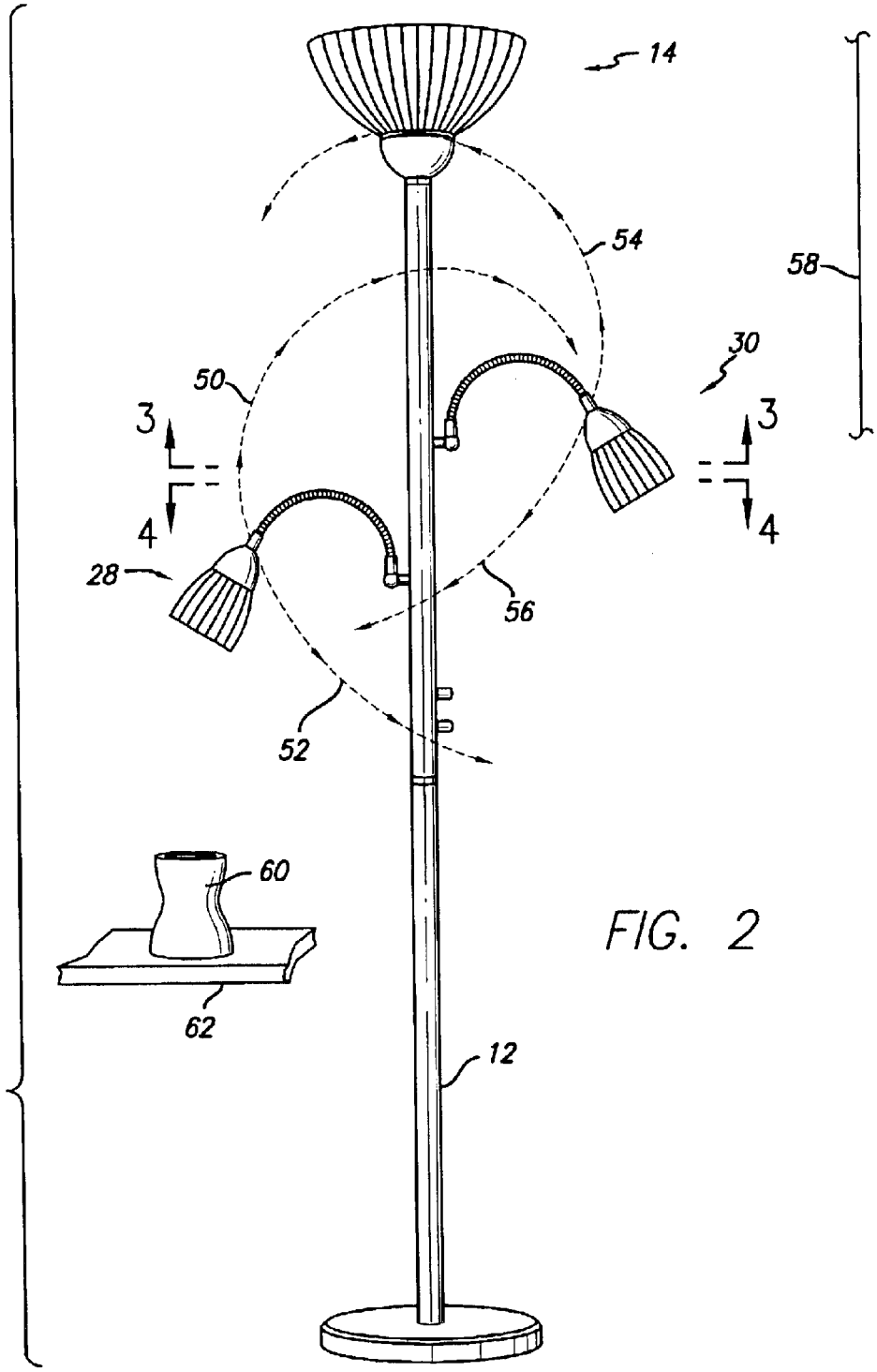
FIG. 2 is similar to FIG. 1 but illustrates the positioning of the task lights in a manner disposed vertically along the longitudinal axis of the stem.

As is illustrated in FIG. 2 to which reference is hereby made, each of the task lights 28 and 30 may be maneuvered as a result of the connection by the fully flexible arm to the stem 12 to a plurality of positions which may be generally vertically oriented with respect to the longitudinal axis of the stem 12. For example, the task light 28 may be moved from the position illustrated in FIG. 2 along an arc shown by the dashed line 50 upwardly to a position which extends beyond the center line of the stem 12. Similarly, the arm may be positioned downwardly as shown by the dashed line 52 to a position which goes beyond the center line of the stem 12. Likewise, the task light 30 may also be maneuvered upwardly as shown by the dashed line 54 or downwardly as shown by the dashed line 56. It should be recognized by those skilled in the art that through such manipulation of the task lights 28 and 30 the light emanating therefrom may be directed in an arc from a position pointing directly downwardly or even to the opposite side of the stem from that upon which the lamp is affixed to upwardly and directed either to the left or right as seen in FIG. 2. If a wall 58 or a similar surface is adjacent the lamp, then light emanating from the task light 30 may be bounced off the surface of the wall 58 and into the area adjacent the lamp to supplement the light emanating from the general area lighting means 14. At the same time the task light 28 may be positioned to highlight an object 60 which may be positioned upon a shelf or table 62. Thus, it can be seen with a structure such as that shown in FIG. 2 with the fully flexible arms allowing the task lights to be swept vertically upwardly or downwardly in various positions, the light emanating from the task lights 28 and 30 may be utilized for various purposes.

Figure 3:
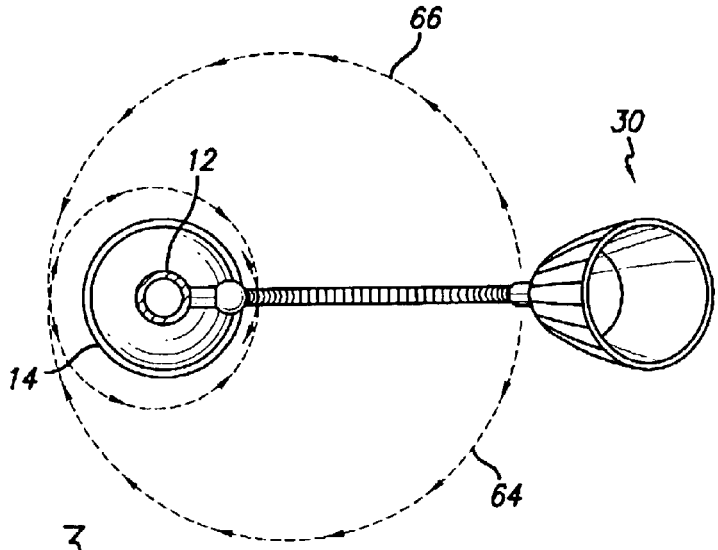
FIG. 3 is taken about the lines 3—3 of FIG. 2 and illustrates the horizontal positioning of one of the task light.

As is illustrated in FIG. 3, the task light 30 may also be rotated around the stem 12 in a clockwise direction as shown by the dashed line 64 to positions occupying the opposite side from that to which it is attached. At the same time, the task light 30 may be positioned in a counter-clockwise direction as shown by the dashed line 66, also to a position which is on the opposite side to that from which it is affixed. In fact, it may be positioned completely about the stem 12 so that the light is fully positioned at a multiplicity of positions completely encircling the stem 12.

Figure 4:
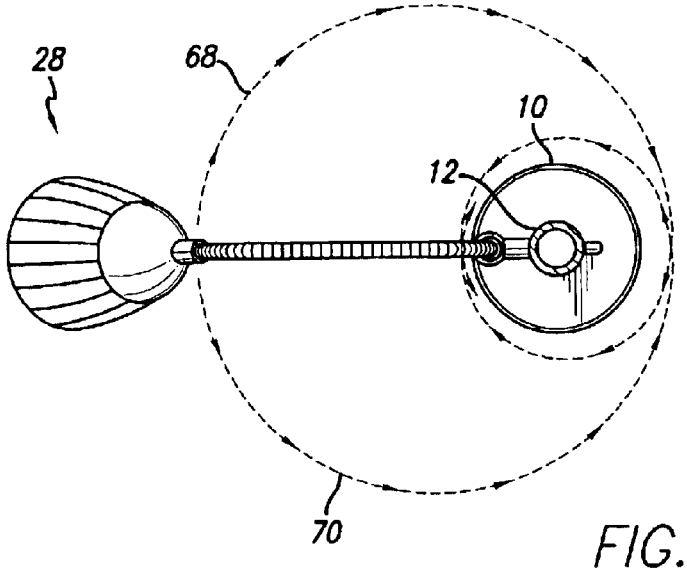
FIG. 4 is taken about the lines 4—4 of FIG. 2 and illustrates the horizontal positioning of the other task light.

Similarly as shown in FIG. 4, the task light 28 may be positioned in a clockwise direction as illustrated by the dashed line 68 or in a counter-clockwise direction as illustrated by the dashed line 70. Similar to that illustrated for the task light 30, the task light 28 may also be positioned in a way such that it totally wraps around the stem 12 in a clockwise or counter-clockwise direction.

By considering the illustrations set forth in FIGS. 2, 3 and 4, it should be recognized that the task lights 28 and 30 may be positioned at a multiplicity of points surrounding the stem 12 which by incorporating the vertical movement as shown in FIG. 2 with the circular or horizontal movements as shown in FIGS. 3 and 4, one can envision a surface surrounding the stem 12 and extending up and down which is defined by all possible positions of the second or distal end of each of the flexible arms 36 and 38. Such flexibility of positioning of the task lights 28 and 30 has not hitherto been available. As above discussed, such positioning provides the ability to greatly enhance the general area lighting by bouncing illumination from the task lights 28 and 30 off adjacent surfaces such as walls or the ceiling as may be desired or, alternatively, to also highlight various objects which may appear on walls or on tables or shelves or on the floor adjacent the lamp-as may be desired. As will be recognized in the past, the task lights were generally used for specific lighting purposes such as reading or to highlight a photograph, sculpture or the like. Through utilization of the structure of the present invention, with the task lights being connected by the use of fully flexible arms such limitations no longer exist.

Figure 5:
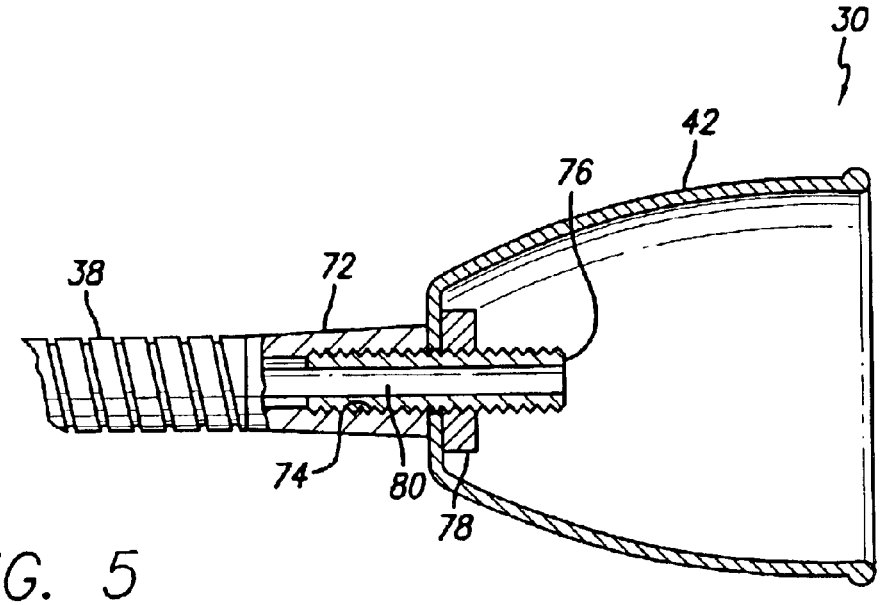
FIG. 5 is a partial view taken about the circle 5, as shown in FIG. 1, illustrating the connection of the task light to the distal end of the arm.

By reference to FIG. 5, there is shown the means by which the task light 30 is affixed to the distal end of the flexible arm 38. As is therein shown, the flexible arm 38 terminates by a portion 72 which is non-flexible and which defines an internally threaded bore 74. A threaded hollow nipple 76 is threadably received within the threaded bore 74. Positioned over the threaded end of the nipple 76 which extends from the non-flexible end 72 is a fitting 42 which is held in place by a nut 78 which is threadably received over the external threaded portion of the nipple 76. Also fitted over the end of the nipple 76 would be a typical light socket (not shown) as is well known to those skilled in the art. The flexible arm 38 and the nipple 76 are hollow as shown at 80 for the purpose of permitting electrical wiring which is connected to the core 20 to be connected to the appropriate light bulb position within the task light 30.

Figure 6:
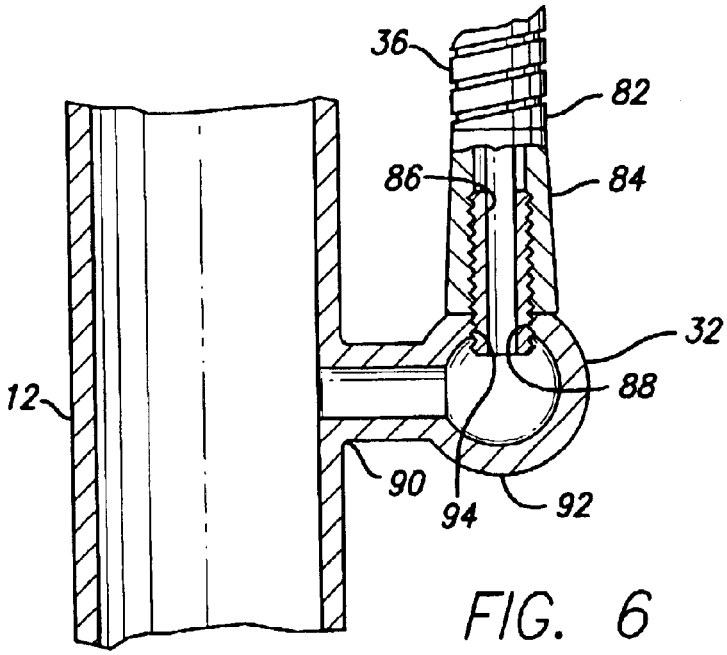
FIG. 6 is a partial view taken at 6 in FIG. 1, illustrating the connection of the other end of the flexible arm to the stem.

As is shown in FIG. 6, the first end 82 of the fully flexible arm 36 includes a non-flexible portion 84 defining a threaded bore 86 into which is threadably received a threaded nipple 88. The member 32, which is non-removably connected to the stem 12 at a juncture 90 there between as by welding, soldering or the like, defines a hollow member 92, also defining a threaded bore 94. The threaded nipple 88 is threadably received within the threaded bore 94. Through the construction for attaching the fully flexible arm to the stem 12 and to the respective task light it can be seen that each end of the fully flexible arm is rigidly attached to the stem 12 and to the respective task light. Although as illustrated, the fully flexible arm is threadably received and thus could be threadably removed such is not intended in the normal use of the tree torchiere lamp of the present invention.

There has thus been disclosed a tree torchiere which includes a pair of task lights attached to the stem extending between the base and the general area lighting means by means of a fully flexible arm, which permits each of the task lights to be positioned in a multitude of positions defined by all of the possible positions which the second or distal end of the flexible arm may assume surrounding the stem.

What is claimed is:

1. A tree torchiere lamp comprising:

a base for supporting said lamp;

an elongated stem having first and second ends, said first end being connected to said base;

a general area lighting member carried by said second end of said stem;

a plurality of arms each having first and second ends;

means for non-rotatably affixing said first end of each arm to said stem in a longitudinally spaced apart position thereon intermediate said base and said general area lighting member which includes a hollow member non-removably affixed to said stem;

a plurality of task lights, each said task light includes a closed end defining an opening therethrough;

means for non-rotatably affixing one of said plurality of task lights to the second end of each of said arms which includes a non-flexible second end defining a first threaded bore therein and a first threaded nipple threadably received within said threaded bore; said threaded nipple being received within said opening and a retaining nut threadably received on said nipple and securing said task light in place on said second end of said arm; and each of said arms being flexible along substantially its entire length to permit said task light to be directed to any position desired on a surface surrounding said stem and defined by all possible positions of the second end of each said arm, said first end of each of said flexible arms includes a non-flexible portion defining a second threaded bore therein, a second threaded nipple threadably received within said second threaded bore, said hollow member defining a third threaded bore, said second threaded nipple being threadably received within said third threaded bore.

* * * * *